US011208750B2

(12) United States Patent
Bodine et al.

(10) Patent No.: US 11,208,750 B2
(45) Date of Patent: Dec. 28, 2021

(54) LAUNDRY APPLIANCE WITH A DEFLECTOR

(71) Applicant: WHIRLPOOL CORPORATION, Benton Harbor, MI (US)

(72) Inventors: Darryl C. Bodine, St. Joseph, MI (US); Donald E. Erickson, Stevensville, MI (US); Gregg P. Fitzgerald, Eau Claire, MI (US); Stephen D. Ostdiek, St. Joseph, MI (US); Marcel Schmidt, Poprad (SK); Todd J. Tunzi, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 119 days.

(21) Appl. No.: 16/668,579

(22) Filed: Oct. 30, 2019

(65) Prior Publication Data

US 2020/0208324 A1 Jul. 2, 2020

Related U.S. Application Data

(60) Provisional application No. 62/786,366, filed on Dec. 29, 2018.

(51) Int. Cl.

| | |
|---|---|
| ***D06F 37/26*** | (2006.01) |
| ***D06F 39/08*** | (2006.01) |
| ***D06F 39/14*** | (2006.01) |

(52) U.S. Cl.

CPC ..... *D06F 37/266* (2013.01); *D06F 37/267* (2013.01); *D06F 39/088* (2013.01); *D06F 39/14* (2013.01)

(58) Field of Classification Search

CPC .... D06F 37/266; D06F 37/267; D06F 39/088; D06F 39/14

USPC ..... 68/196

See application file for complete search history.

(56) References Cited

U.S. PATENT DOCUMENTS

| | | | | |
|---|---|---|---|---|
| 2,941,390 | A | 6/1960 | Frey | |
| 4,510,776 | A * | 4/1985 | McNally | D06F 37/28 312/139.2 |
| 7,712,338 | B2 | 5/2010 | Tanaka et al. | |
| 8,261,582 | B2 | 9/2012 | Graute et al. | |
| 8,464,560 | B2 | 6/2013 | Kim et al. | |
| 8,464,561 | B2 | 6/2013 | Brinkmann | |
| 8,528,223 | B2 | 9/2013 | Alisch et al. | |
| 8,661,707 | B2 | 3/2014 | Dittmer et al. | |
| 8,875,416 | B2 | 11/2014 | Anderson et al. | |

(Continued)

FOREIGN PATENT DOCUMENTS

| | | |
|---|---|---|
| CN | 103911812 B | 2/2016 |
| CN | 107401030 A | 11/2017 |

(Continued)

*Primary Examiner* — Tinsae B Ayalew

(74) *Attorney, Agent, or Firm* — Price Heneveld LLP

(57) ABSTRACT

A laundry appliance includes a cabinet defining an aperture in a front surface thereof. A drum is disposed within the cabinet. The drum defines an access opening that aligns with the aperture. A door is coupled to the cabinet and is operable between closed and opened positions relative to the aperture. A bellows extends along a perimeter of the aperture and proximate the access opening. A deflector extends along at least a portion of the perimeter of the aperture. The deflector extends into an interior of the drum over the bellows.

20 Claims, 13 Drawing Sheets

(56) References Cited

U.S. PATENT DOCUMENTS

| | | | |
|---|---|---|---|
| 9,045,853 | B2 | 6/2015 | Kim et al. |
| 9,051,679 | B2 | 6/2015 | Kwon et al. |
| 9,121,128 | B2 | 9/2015 | Hong et al. |
| 9,637,855 | B2 | 5/2017 | Buso et al. |
| 9,822,475 | B2 | 11/2017 | Thorpe |
| 9,869,048 | B2 | 1/2018 | Burgess et al. |
| 9,903,059 | B2 | 2/2018 | Anderson et al. |
| 10,373,770 | B2 | 8/2019 | Bodine et al. |
| 10,422,064 | B2 | 9/2019 | Seong et al. |
| 10,585,407 | B2 | 3/2020 | Bodine et al. |
| 2005/0015892 | A1 | 1/2005 | Park et al. |
| 2006/0174663 | A1 | 8/2006 | Cimetta et al. |
| 2007/0295037 | A1 | 12/2007 | Blomberg et al. |
| 2013/0276322 | A1 | 10/2013 | Anderson et al. |
| 2016/0145790 | A1 | 5/2016 | Burgess et al. |

FOREIGN PATENT DOCUMENTS

| | | | |
|---|---|---|---|
| CN | 207193607 | U | 4/2018 |
| CN | 208266517 | U | 12/2018 |
| DE | 19706283 | A1 | 8/1998 |
| DE | 102018101299 | A1 | 7/2019 |
| EP | 1321558 | A1 | 6/2003 |
| EP | 1522623 | A1 | 4/2005 |
| EP | 1408150 | B1 | 3/2008 |
| EP | 2078777 | A1 | 7/2009 |
| EP | 1367169 | B1 | 2/2010 |
| JP | 2007202741 | A | 8/2007 |
| JP | 2009118948 | A | 6/2009 |

* cited by examiner

LAUNDRY APPLIANCE WITH A DEFLECTOR

CROSS-REFERENCE TO RELATED APPLICATIONS

This application claims priority to U.S. Provisional Application No. 62/786,366, filed on Dec. 29, 2018, entitled, "LAUNDRY APPLIANCE WITH A DEFLECTOR," the disclosure to which is hereby incorporated herein by reference in its entirety.

BACKGROUND OF THE DISCLOSURE

The present disclosure relates to a laundry appliance, and more specifically, to a laundry appliance having a deflector.

SUMMARY OF THE DISCLOSURE

According to one aspect of the present disclosure, a laundry appliance includes a cabinet that defines an aperture in a front surface thereof. A drum is disposed within the cabinet. The drum defines an access opening that aligns with the aperture. A door is coupled to the cabinet and is operable between closed and opened positions relative to the aperture. A bellows extends along a perimeter of the aperture and proximate the access opening. A deflector extends along at least a portion of the perimeter of the aperture. The deflector extends into an interior of the drum over the bellows.

According to another aspect of the present disclosure, a laundry appliance includes a cabinet that defines an aperture. A drum is disposed within the cabinet. The drum defines an access opening that aligns with the aperture. A bellows is coupled to the cabinet proximate the opening. A deflector is coupled to the cabinet proximate the aperture and extends toward the drum over the bellows. The deflector includes a top coupled proximate an upper portion of the opening and a bottom coupled to a bottom portion of the aperture. The bottom has a greater depth than the top.

According to yet another aspect of the present disclosure, a laundry appliance includes a cabinet that defines an aperture. A tub is positioned within the cabinet. A drum is positioned within the tub. The tub defines an interior. A bellows is coupled to the cabinet and extends between the cabinet and the tub. A deflector is coupled to the cabinet proximate the aperture. The deflector includes a bottom and side portions extending therefrom. The bottom is coupled to the cabinet proximate a lower portion of the aperture and the side portions are coupled to the cabinet proximate respective sides of the aperture.

These and other features, advantages, and objects of the present disclosure will be further understood and appreciated by those skilled in the art by reference to the following specification, claims, and appended drawings.

Figure 1:
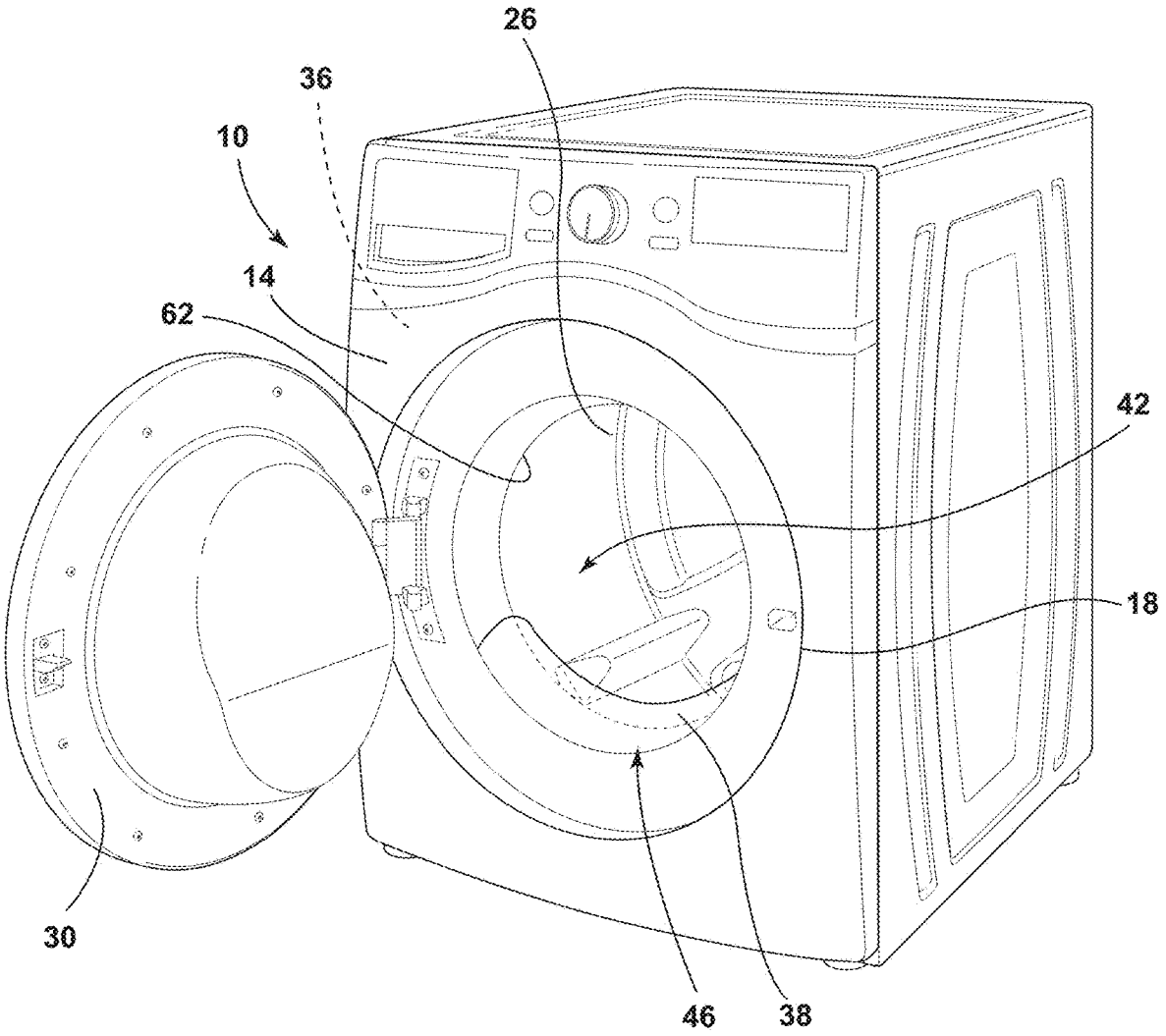
FIG. 1 is a front perspective view of a laundry appliance that has a deflector coupled to a cabinet, according to at least one example.

The components in the figures are not necessarily to scale, emphasis instead being placed upon illustrating the principles described herein.

DETAILED DESCRIPTION

The present illustrated embodiments reside primarily in combinations of method steps and apparatus components related to a laundry appliance with a deflector. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

With respect to FIGS. 1-21, reference numeral 10 generally designates a washer having a cabinet 14 that defines an aperture 18 on a front surface 22. A drum 26 is positioned within the cabinet 14 and defines an access opening 62 configured to align with the aperture 18 of the cabinet 14. A door 30 is coupled to the cabinet 14 proximate the aperture 18 and operable between opened and closed positions. A bellows 34 is positioned about the aperture 18 between the cabinet 14 and a tub 36 disposed within the cabinet 14. Additionally, the washer 10 includes a deflector 38 coupled to the cabinet 14 proximate the aperture 18. The deflector 38 extends toward an interior 42 of the drum 26 through the access opening 62. In the depicted example, the washer 10 is illustrated as a horizontal-axis washer. However, it is contemplated that the washer 10 may be a vertical-axis washer, a top-load washer, a front-load washer, combination washer/dryers, and/or other types of washers and laundry appliances.

Figure 2:
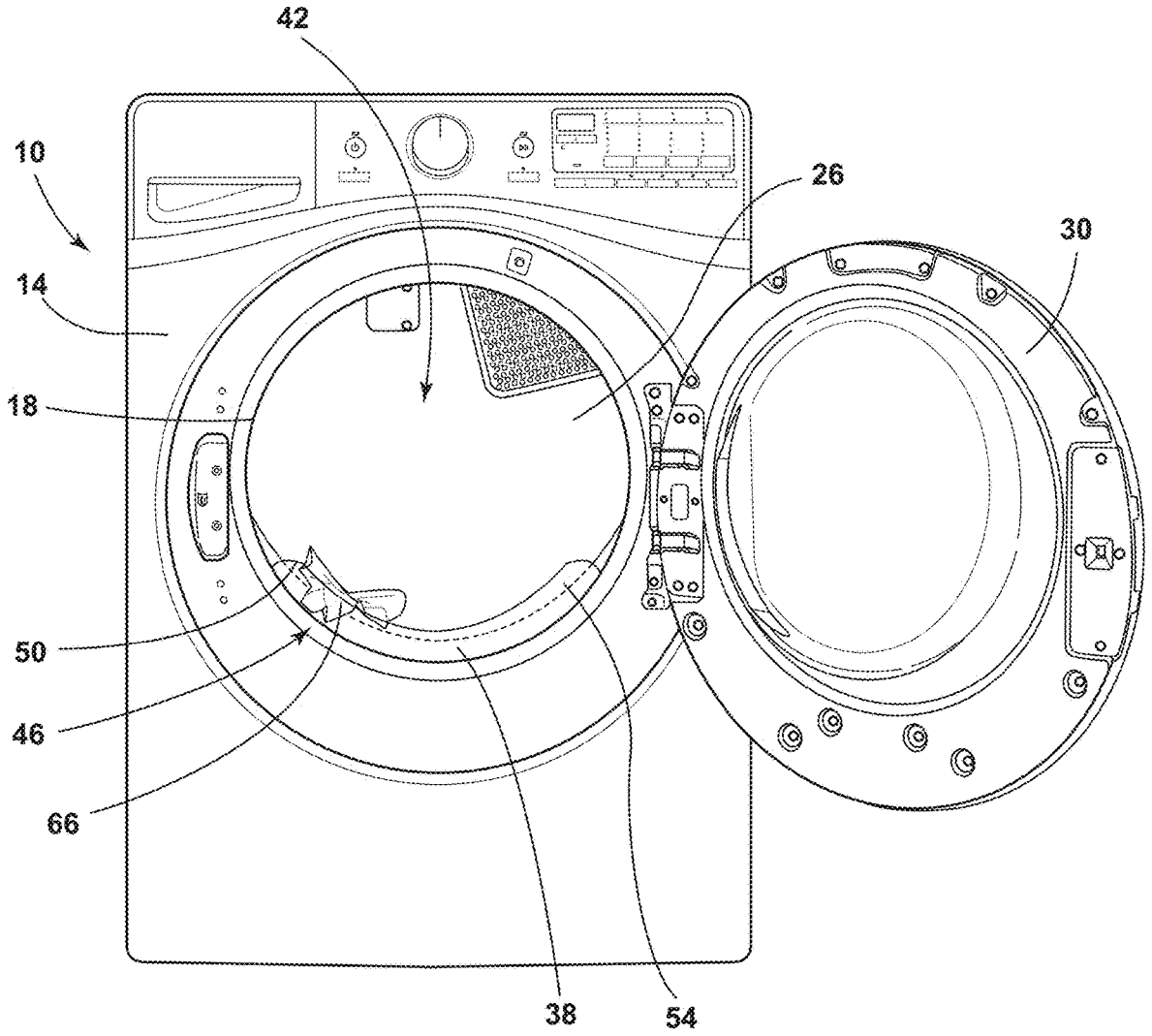
FIG. 2 is a front elevational view of a laundry appliance that has a deflector extend towards a drum within a cabinet, according to at least one example.
Figure 3:
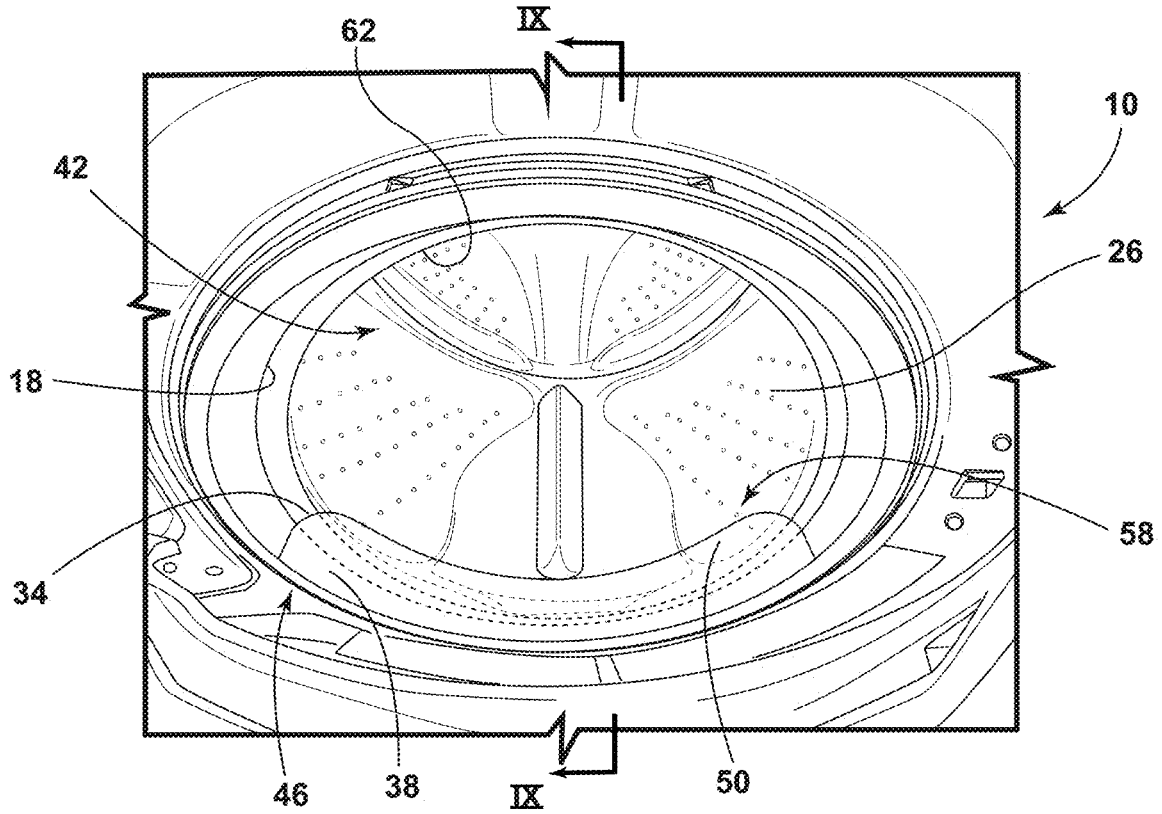
FIG. 3 is a partial front perspective view of a laundry appliance with a deflector, according to at least one example.

Referring to FIGS. 1-3, the deflector 38 is shown coupled to a bottom portion 46 of the aperture 18 of the cabinet 14 of the washer 10. The aperture 18 defines a perimeter and the deflector 38 is coupled to at least a portion of the perimeter. The deflector 38 defines an angled surface 50 that extends toward the interior 42 of the drum 26. At least a portion of the deflector 38 can extend into the interior 42 of the drum 26. In this way, the deflector 38 extends from the aperture 18, over the bellows 34, and at least partially into the drum 26. The deflector 38 forms an arcuate body 54 that slopes downwards toward a lower portion 58 of the drum 26. The deflector 38 is typically configured as an obliquely-oriented cylindrical section. Moreover, the deflector 38 may be pliable, rigid, and/or a combination thereof.

In various examples, the access opening 62 of the drum 26 can be substantially concentrically aligned with the aperture 18 of the cabinet 14. Additionally or alternatively, the access opening 62 can be offset from the aperture 18 of the cabinet 14. In such examples, the access opening 62 is typically at least partially positioned below the aperture 18 of the drum 26. Where the access opening 62 is offset, the tub 36, and accordingly the drum 26, are positioned at an angle within the cabinet 14 of the washer 10, such that the bellows 34 are coupled to the cabinet 14 of the washer 10 and the angled tub 36 positioned therein. In other words, the bellows 34 can be an obliquely-oriented bellows assembly. The bellows 34 are configured to form an oblique cylinder or frusto-conical shape that defines a downward angle between the aperture 18 and the offset tub 36. Having the bellows 34 obliquely-oriented is advantageous to allow the deflector 38 to be oriented at a desired angle, such that the deflector 38 can guide laundry 66 to the desired position within the drum 26. In various examples, the deflector 38 operates to prevent clothing (e.g., laundry 66) from contacting the bellows 34. Use of the deflector 38 is also advantageous to protect the bellows 34 and/or assist a consumer to load the laundry 66 into the drum 26. It is contemplated that a size and/or shape of the access opening 62 is determined by the size and/or shape of the drum 26.

Figure 4:
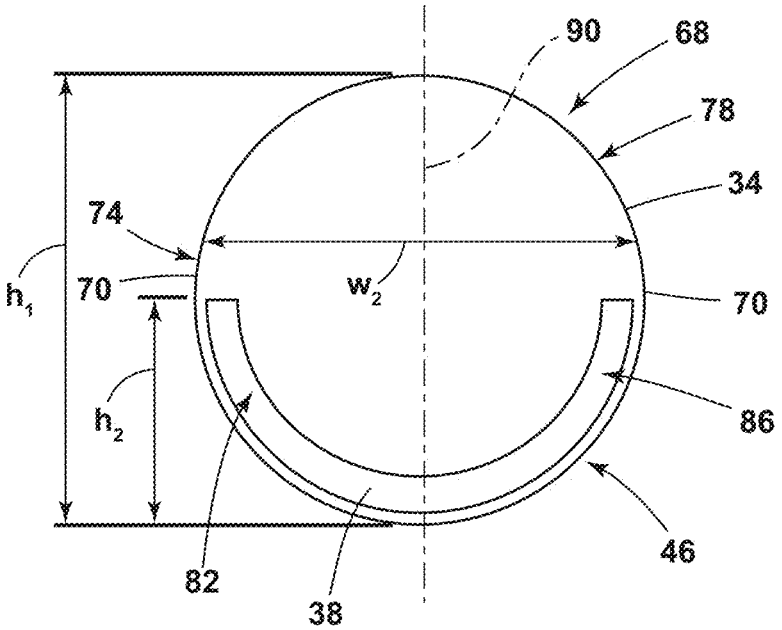
FIG. 4 is a schematic drawing of the deflector coupled to a bottom portion of an aperture defined in a cabinet, according to at least one example.
Figure 5:
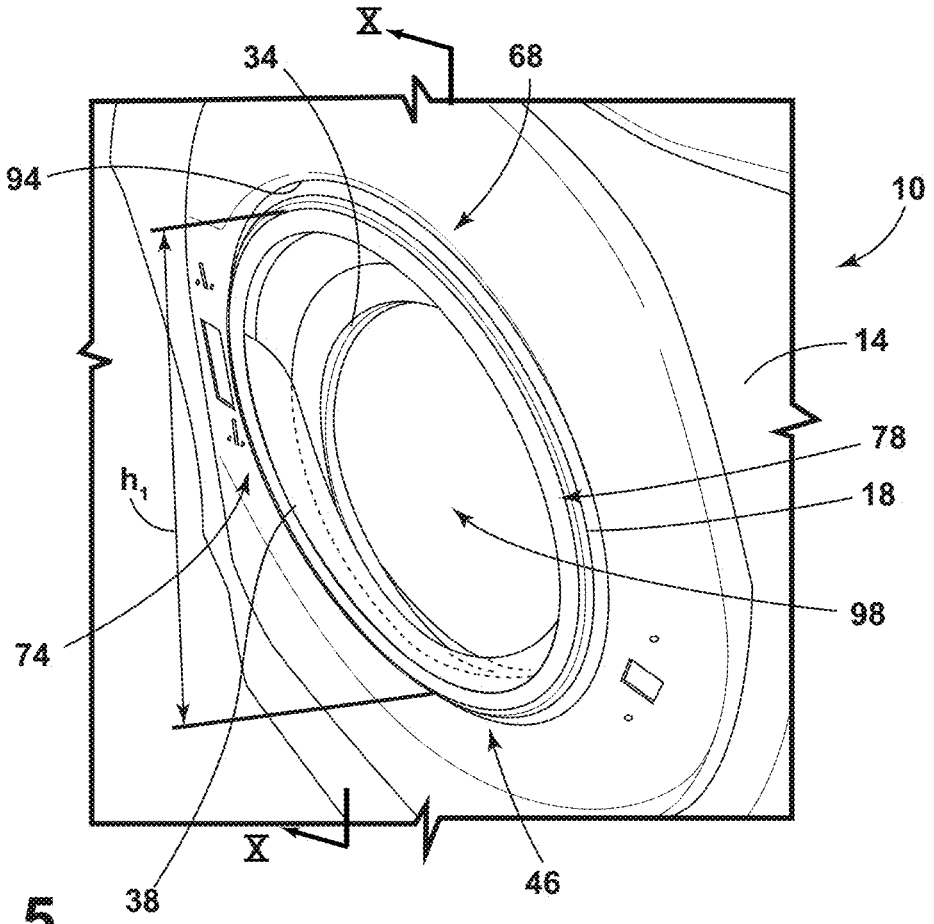
FIG. 5 is a partial front perspective view of a deflector coupled to a laundry appliance, according to at least one example.

Referring now to FIGS. 4 and 5, the bellows 34 extends around at least a portion of a perimeter of the aperture 18 of the cabinet 14 and the access opening 62 (FIG. 1) of the drum 26. Typically, the bellows 34 extends around the entire perimeter of the aperture 18 of the cabinet 14. In the depicted example, the deflector 38 is illustrated extending approximately 180° around the bottom portion 46 of the aperture 18. Side portions 82, 86 of the deflector 38 extend proximate an upper portion 68 of the aperture 18. According to various aspects, the deflector 38 can extend approximately to a midpoint 70 on each of the left and right sides 74, 78 of the aperture 18, the midpoint 70 being approximately half the height $h_1$ of the aperture 18. The deflector 38 may extend to a point below the midpoint 70 and/or may extend to a point above the midpoint 70. It is contemplated that the side portions 82, 86 of the deflector 38 extends approximately a same height $h_2$, such that the side portions 82, 86 are substantially mirror images of one another over a y-axis 90 of the aperture 18. It is also contemplated that the side portions 82, 86 of the deflector may not extend to a same height $h_2$, such that the side portions 82, 86 may not be substantially mirror images of one another over the y-axis 90.

In various examples, the cabinet 14 includes a flange 94 around the aperture 18. The flange 94 can extend from the cabinet 14 towards a center portion 98 of the aperture 18. The deflector 38 is coupled to an inner surface 102 (FIG. 17) of the flange 94. It is contemplated that the deflector 38 may be coupled to other portions of the cabinet 14 proximate the aperture 18.

Figure 6:
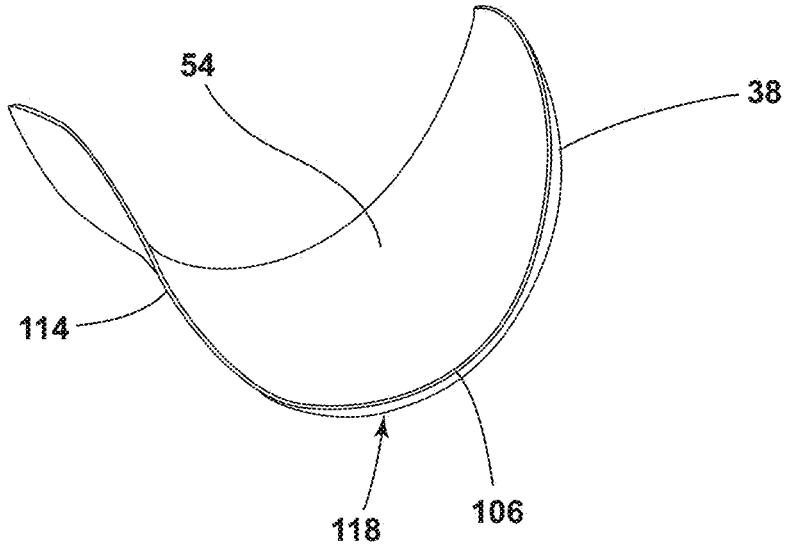
FIG. 6 is a schematic drawing of a front perspective view of a deflector, according to at least one example.
Figure 7:
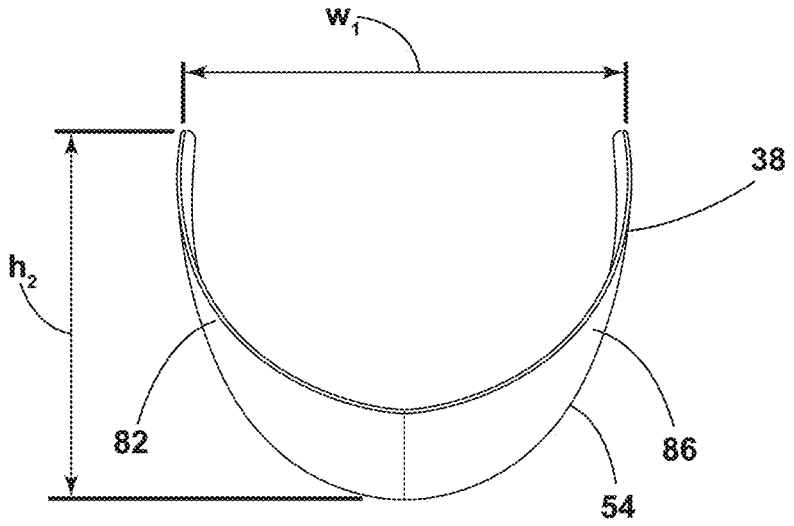
FIG. 7 is a rear elevational view of a deflector, according to at least one example.
Figure 8:
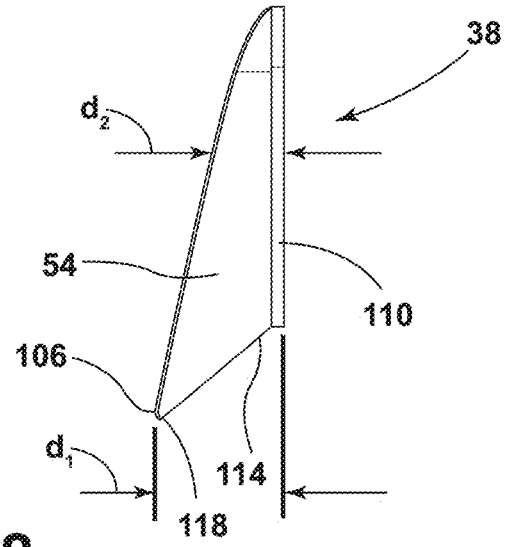
FIG. 8 is a side elevational view of a deflector, according to at least one example.

Referring to FIGS. 6-8, the deflector 38 includes the arcuate body 54 and a drip edge 106. In this way, the deflector 38 is configured as an obliquely-oriented cylindrical section and/or an angled chute. The drip edge 106 is a bottom interior edge 108 of the deflector 38 disposed within the interior 42 (FIG. 1) of the drum 26. The deflector 38 can also include a rim 110 configured to correspond with the flange 94 (FIG. 5) proximate the aperture 18 (FIG. 1). In various examples, a width $w_1$ of the deflector 38 corresponds with a width $w_2$ (FIG. 4) of the aperture 18 (FIG. 3). The width $w_1$ may be in a range of from approximately 350 mm to approximately 450 mm. The deflector 38 may also have the height $h_2$ in a range of from approximately 270 mm to approximately 380 mm. Additionally, the deflector 38 can have a bottom depth (e.g., a first depth) $d_1$ in a range of from approximately 50 mm to approximately 150 mm. It is contemplated that the width $w_1$, the height $h_2$, and/or the bottom depth $d_1$ can vary based on the type, model, and/or size of the washer 10 and/or laundry appliance in which the deflector 38 is coupled.

In various examples, as exemplified in FIGS. 6-8, the deflector 38 includes the side portions 82, 86 that extend a shorter distance toward the interior 42 (FIG. 1) of the drum 26 (FIG. 1) compared to a bottom 114 of the deflector 38. As such, the bottom depth $d_1$ is typically greater compared to a side depth $d_2$ (e.g., a second depth). It is also contemplated that the bottom depth $d_1$ and the side depth $d_2$ may be substantially similar. In various examples, the side depth $d_2$ may decrease and/or taper, such that the side depth $d_2$ decreases further from the bottom depth $d_1$. The side depth $d_2$ can decrease in a linear manner, a parabolic manner, and/or any other practicable manner.

As exemplified in FIGS. 1-3 and 6, the deflector 38 typically includes a lower extension 118 that defines the bottom 114 of the deflector 38. The lower extension 118 extends at an oblique-orientation toward a lower portion 58 of the drum 26. Stated differently, the lower extension 118 forms the angled surface 50 of the deflector 38. The lower extension 118 often includes the drip edge 106. The drip edge 106 extends downward from the lower extension 118 of the deflector 38 toward and/or into the drum 26. In various examples, the drip edge 106 has a thickness greater than the thickness of the arcuate body 54 of the deflector 38. The drip edge 106 allows water on the deflector 38 to drip from the deflector 38 into the lower portion 58 of the drum 26. The drip edge 106 may also operate to direct the laundry 66 (FIG. 2) to stay within the interior 42 of the drum 26. Additionally, the drip edge 106 can be advantageous to control water flow within the drum 26 and/or to protect the bellows 34 (e.g., prevent the laundry 66 from coming into contact with the bellows 34).

Figure 9:
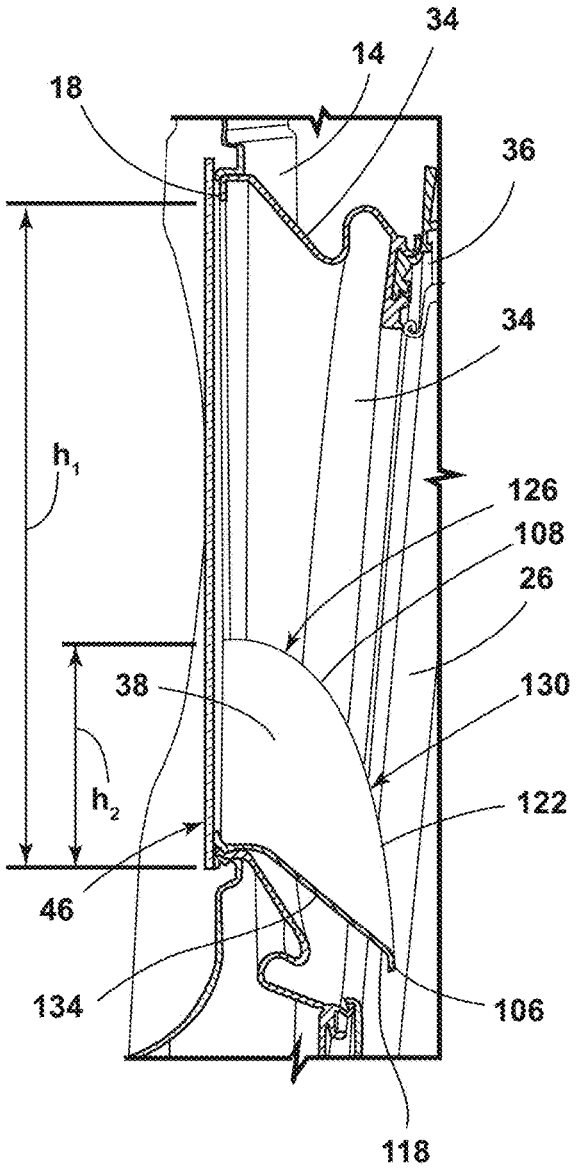
FIG. 9 is a partial cross-sectional view of a deflector that extends toward an interior of a drum of FIG. 3, taken along line IX-IX.
Figure 10:
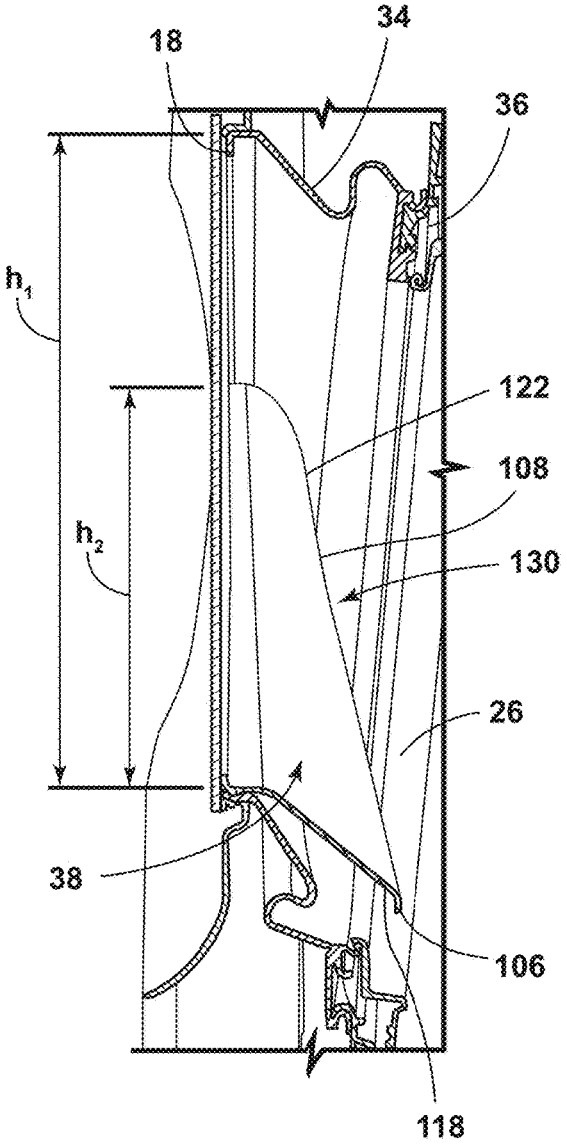
FIG. 10 is a partial cross-sectional view of a deflector that extends toward an interior of a drum of FIG. 5, taken along line X-X.
Figure 11:
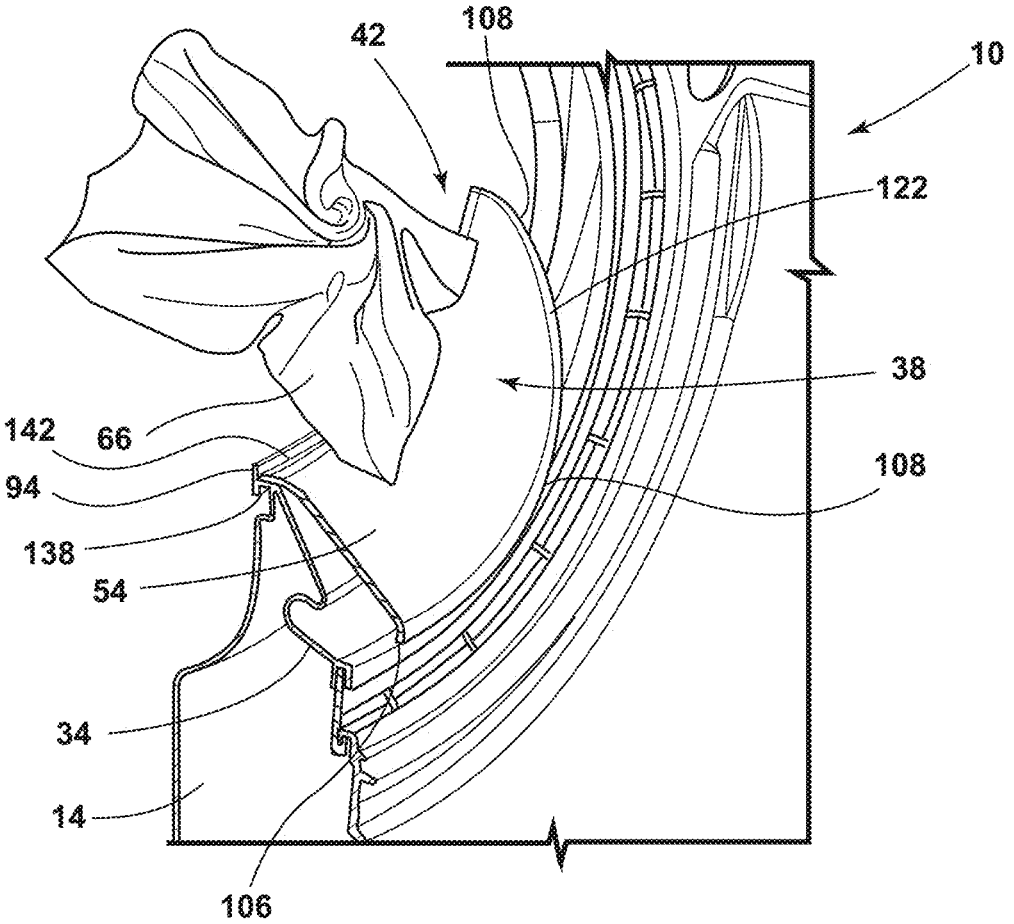
FIG. 11 is a partial front perspective view, in cross section, of a deflector that extends toward an interior of a drum, according to at least one example.
Figure 12:
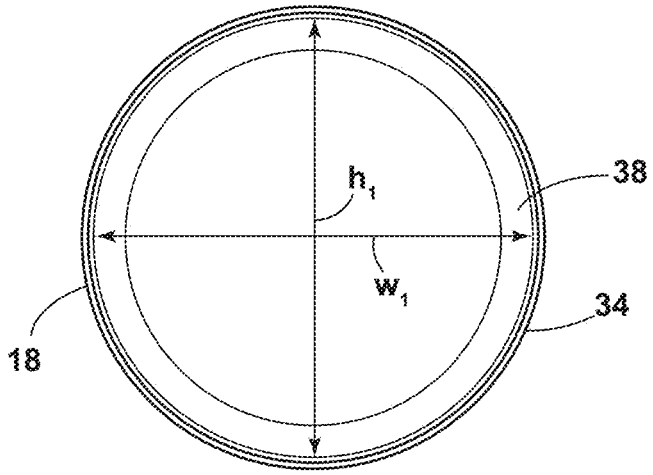
FIG. 12 is a schematic drawing of a deflector coupled to an entire perimeter of an aperture of a cabinet, according to at least one example.
Figure 13:
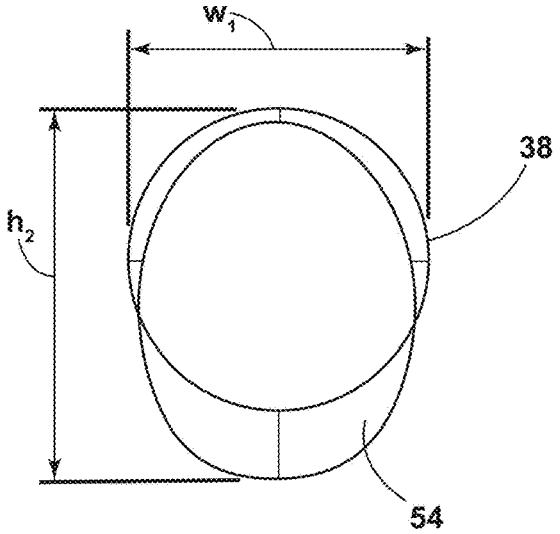
FIG. 13 is a front elevational view of a deflector, according to at least one example.
Figure 14:
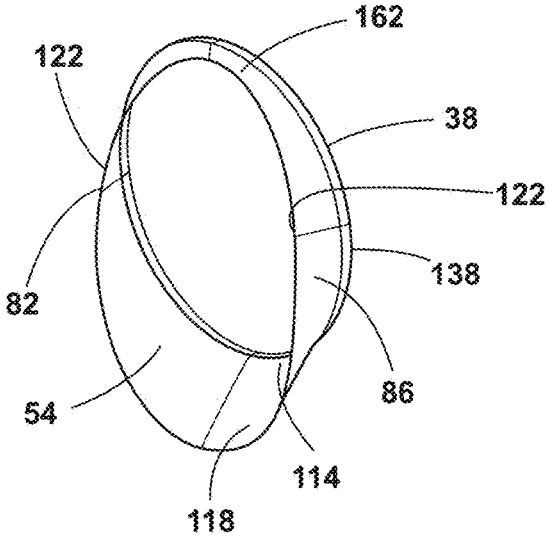
FIG. 14 is a rear perspective view of a deflector, according to at least one example.
Figure 15:
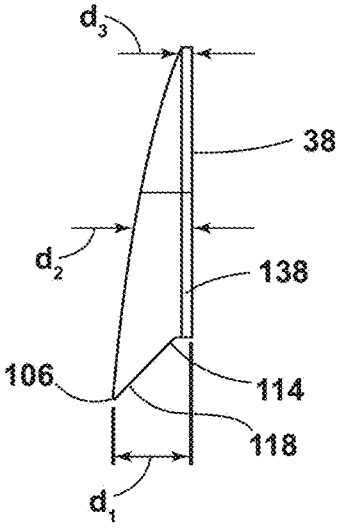
FIG. 15 is a side elevational view of a deflector, according to at least one example.

Referring to FIGS. 9-11, the deflector 38 is shown having a variety of shapes and configurations. The deflector 38 extends toward the interior 42 of the drum 26 at different angles based on the height $h_2$ of the deflector 38. Additionally or alternatively, the side interior edge 122 of the deflector 38 has different sloped configurations based on the shape and/or size of the deflector 38. As illustrated in FIG. 9, the deflector 38 is coupled to less than 180° of the perimeter of the aperture 18 of the cabinet 14. In such examples, the deflector 38 may be coupled to approximately 90° of the perimeter of the aperture 18 along the bottom portion 46 of the aperture 18. In such examples, a side interior edge 122 of the deflector 38 arches downward to the bottom interior edge 108. The side interior edge 122 of the side portions 82, 86 (FIG. 7) include an inward extension 126 that extends inward towards the interior 42 of the drum 26. The side interior edge 122, additionally or alternatively, includes a sloped portion 130 that extends downward at a greater angle compared to the inward extension 126 until the side interior edge 122 meets the drip edge 106. Stated differently, each of the side portions 82, 86 (FIG. 7) of the deflector 38 include the inward extension 126 and the sloped portion 130 that slopes at an oblique-orientation between the inward extension 126 and the lower extension 118. A bottom surface 134 of the deflector 38 typically slopes toward the drip edge 106 in a generally consistent uniform slope.

In examples where the deflector 38 extends approximately 180° about the aperture 18, as illustrated in FIG. 10, the side interior edge 122 includes the sloped portion 130 that extends at a uniform slope towards the drip edge 106. In such examples, the deflector 38 may not include the inward extension 126, or alternatively, may include a smaller inward extension 126 relative to the deflector 38 illustrated in FIG. 9. Referring again to FIG. 10, the difference in shape of the deflector 38 based on the height $h_2$ of the deflector 38 typically allows the differently shaped deflectors 38 to similarly operate to provide the same benefits for a variety of appliance designs. The deflector 38 having the sloped and/or arched side interior edges 122 can operate to direct water and/or laundry 66 away from the aperture 18 toward the interior 42 of the drum 26. The shape of the deflector 38 can be informed by the geometry of the bellows 34.

Referring still to FIGS. 9-11, the deflector 38 may include a tab 138 that extends from a front edge 142 thereof. The tab 138 is configured to cooperate with the flange 94 and/or cabinet 14 of the washer 10 to hold the deflector 38 to the cabinet 14. In this way, the deflector 38 is configured as a cantilevered cylindrical extrusion that extends from the cabinet 14. The front edge 142 and the interior edge 108 can have a thickness greater than the thickness of the arcuate body 54 of the deflector 38. In various examples, the side interior and front edges 122, 142 of the deflector 38 have a rolled shape, such that the side interior and front edges 122, 142 extend from the arcuate body 54 and roll back towards the arcuate body 54. The rolled shape can operate to direct laundry 66 toward the interior 42 of the drum 26.

In various examples, the deflector 38 may be configured to deform and/or bend toward the cabinet 14. A space is defined between the drip edge 106 and the cabinet 14 proximate where the bellows 34 couples to the cabinet 14. The drip edge 106 moves into the space, closer to where the bellows 34 couples to the cabinet 14. In a non-limiting example, the deflector 38 can be configured as a living hinge. In another non-limiting example, the deflector 38 could elastically deform. Additionally or alternatively, in another non-limiting example, the deflector 38 can include a hinge assembly, such that at least a portion of the lower extension 118 can rotate about the hinge assembly toward the cabinet 14.

Referring now to FIGS. 12-15, the deflector 38 may extend the entire perimeter of the aperture 18 and be configured as a conical or cylindrical extrusion. Accordingly, the deflector 38 engages an entire perimeter of the bellows 34 and extends over the lower portion of the bellows 34. In such examples, the deflector 38 includes side portions 82, 86 that extend between a top 162 and the bottom 114 of the deflector 38 and include the respective sloping side interior edges 122. The deflector 38 can include the tab 138 extending from the arcuate body 54. Additionally, the deflector 38 forms a circular and/or oblong shape to cooperatively mirror the shape of the aperture 18. In this way, the shape and/or size of the tab 138 is configured to correspond with the aperture 18. In examples where the deflector 38 is coupled to the entire perimeter of the aperture 18, the bottom depth $d_1$ is typically greater than the side depth $d_2$.

Additionally, a top depth $d_3$ (e.g., a third depth) is typically lesser than both the side depth $d_2$ and the bottom depth $d_1$. Accordingly, the bottom 114 of the deflector 38 extends a greater distance towards the interior 42 of the drum 26 (FIG. 1) compared to the top 162 of the deflector 38. In various examples, the side depth $d_2$ decreases and/or tapers, such that the side depth $d_2$ decreases further from the bottom depth $d_1$. Stated differently, the side portions 82, 86 have an increasing side depth $d_2$ from proximate the top 162 to proximate the bottom 114. The deflector 38 can have a height $h_2$ in a range of from approximately 450 mm to approximately 550 mm. The deflector 38 may also have a width $w_1$ in a range of from approximately 350 mm to approximately 450 mm. The bottom depth $d_1$ may be in a range of from approximately 50 mm to approximately 150 mm. However, it is contemplated that the width w, height $h_2$, and bottom depth $d_1$ may vary based on the type, model, and/or size of the washer 10 (FIG. 1) and/or laundry appliance for which the deflector 38 is utilized.

Figure 16:
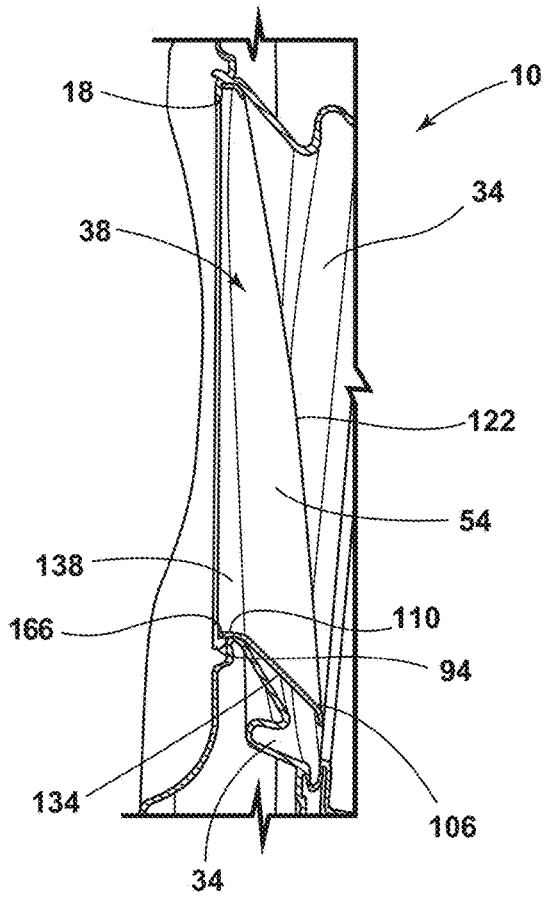
FIG. 16 is a partial side cross-sectional view of a deflector that extends toward an interior of a drum of a laundry appliance, according to at least one example.
Figure 17:
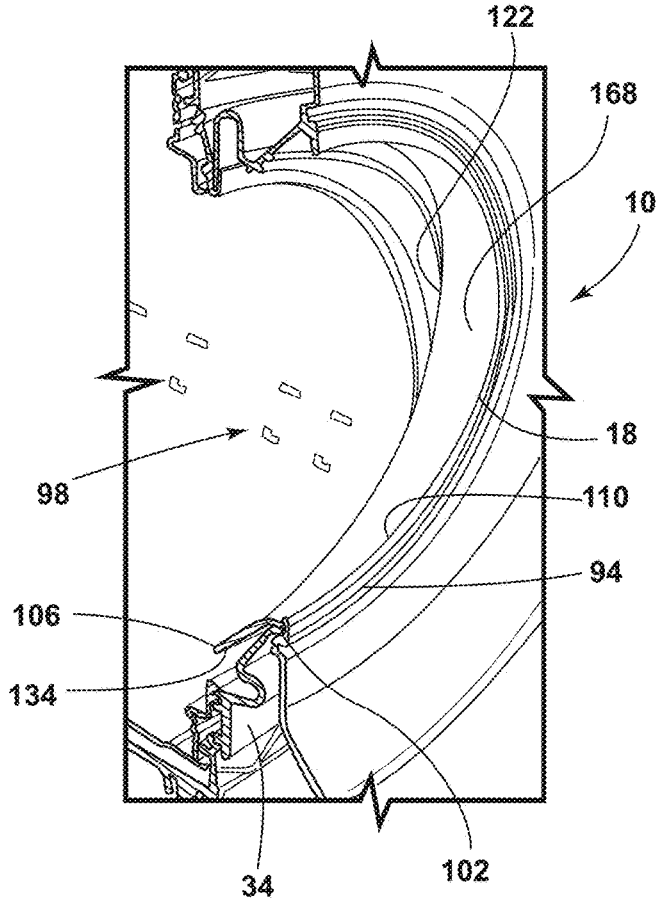
FIG. 17 is a partial front cross-sectional perspective view of a deflector that extends toward an interior of a drum, according to at least one example.

Referring to FIGS. 16 and 17, the side interior edge 122 of the deflector 38 typically slopes downward at a uniform angle to the drip edge 106. The bottom surface 134 extends at a uniform angle towards the drip edge 106, but may be a different angle compared to the side interior edge 122. The bottom surface 134 and the side interior edge 122 extend at different angles to form a funnel-shaped deflector 38, such that the deflector 38 substantially avoids contact with the bellows 34 when the washer 10 is in use. In various examples, the flange 94 is positioned to at least partially overlap the aperture 18 and extends inward toward the bellows 34. This configuration prevents infiltration of fluid between the deflector 38 and the aperture 18. The rim 110 and/or the tab 138 (FIG. 11) of the deflector 38 are configured to cooperate with the flange 94, such that the deflector 38 is positioned on an upward-facing surface 166, such as a ledge, of the flange 94. The flange 94 may also extend towards the center portion 98 of the aperture 18. In such examples, the tab 138 (FIG. 11) of the deflector 38 is configured to cooperate with the inner surface 102 of the flange 94. The tab 138 and/or the rim 110 of the deflector 38 may extend horizontally or vertically away from the arcuate body 54 of the deflector 38 based on the orientation of the flange 94.

The deflector 38 can be included with the washer 10 to improve the aesthetics of the aperture 18 of the washer 10. The use of the deflector 38 is advantageous such that when consumers load and unload the laundry 66 (FIG. 2) from within the washer 10, the consumer can avoid contact with the bellows 34. The deflector 38 can be configured as a bib and/or an angled chute to extend over the bellows 34 toward the interior 42 of the drum 26. A top surface 168 of the arcuate body 54 may also be decorated to improve the aesthetics of the washer 10 and/or the deflector 38. The decorations may include, for example, artwork, designs, instruction labels, and/or a combination thereof. The tapered shape at the deflector 38 also allows for a flow of fluid from near the bellows 34 into the tub 36.

Referring to FIGS. 1-17, according to various aspects, the aperture 18 is defined by the cabinet 14 along a first plane. The access opening 62 of the drum 26 is defined along a second plane. Additionally or alternatively, the interior edge 108 of the deflector 38 extends along a third plane. The first, second, and third planes are typically different from one another. For example, the first plane may be substantially vertical and arranged parallel to the front surface 22 of the cabinet 14. The second plane is obliquely-oriented at a first angle relative to the first plane. The third plane is additionally obliquely-oriented at a second angle relative to the first plane and a different third angle relative to the second plane. The configuration of the obliquely-oriented second and third planes is advantageous for directing the laundry 66 and/or water into the interior 42 of the drum 26.

Figure 18:
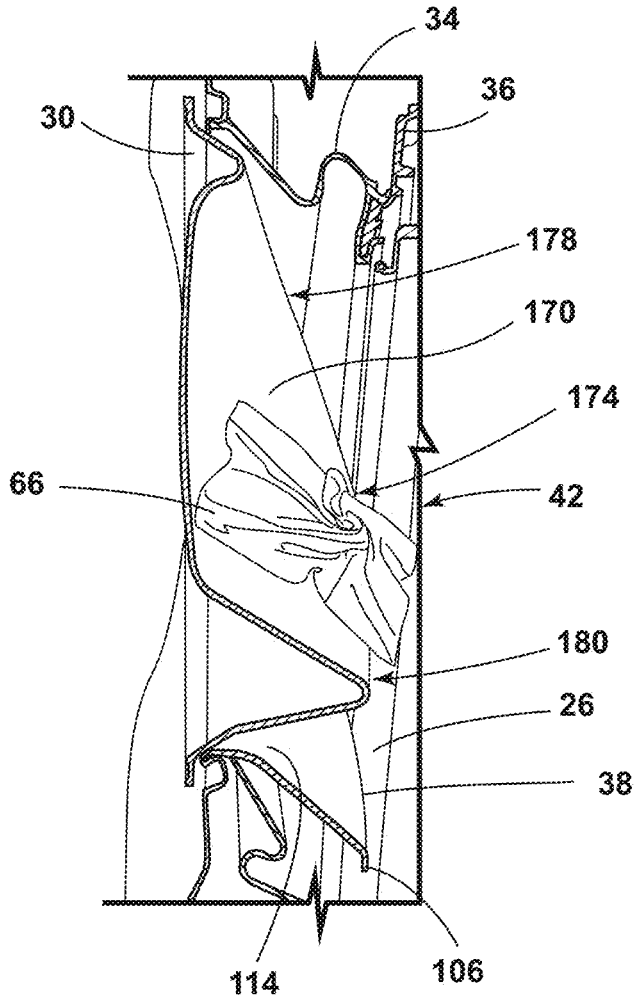
FIG. 18 is a partial cross-sectional view of a deflector cooperating with a door that has a fishbowl glass panel, according to at least one example.

Referring to FIG. 18, the door 30 may be a swing door coupled to the cabinet 14 that includes a glass bowl panel 170. The glass bowl panel 170 extends toward the interior 42 of the drum 26 when the door 30 is in a closed position. In such examples, the glass bowl panel 170 curves and protrudes towards and/or into the drum 26. A central portion 174 and a bottom portion 180 of the glass bowl panel 170 typically extends a greater distance towards the drum 26 than a top portion 178. The central and bottom portions 174, 180 typically extend a same distance toward the interior 42 of the drum 26. The glass bowl panel 170 may operate in a similar manner as the deflector 38 by directing the laundry 66 away from the door 30 and into the interior 42 of the drum 26. The glass bowl panel 170 can be used in combination with the deflector 38. In such examples, the bottom 114 of the deflector 38 extends a greater distance into the interior 42 of the drum 26 than the glass bowl panel 170. Additionally, the glass bowl panel 170 is shaped to avoid contact with the deflector 38 when the door 30 is in the closed position. Stated differently, the deflector 38 extends around the glass bowl panel 170 when the door 30 is in the closed position. This configuration is advantageous for preventing contact and/or interference between the glass bowl panel 170 and the deflector 38. This configuration is also advantageous for preventing the laundry 66 from getting caught between the deflector 38 and the glass bowl panel 170.

Figure 19:
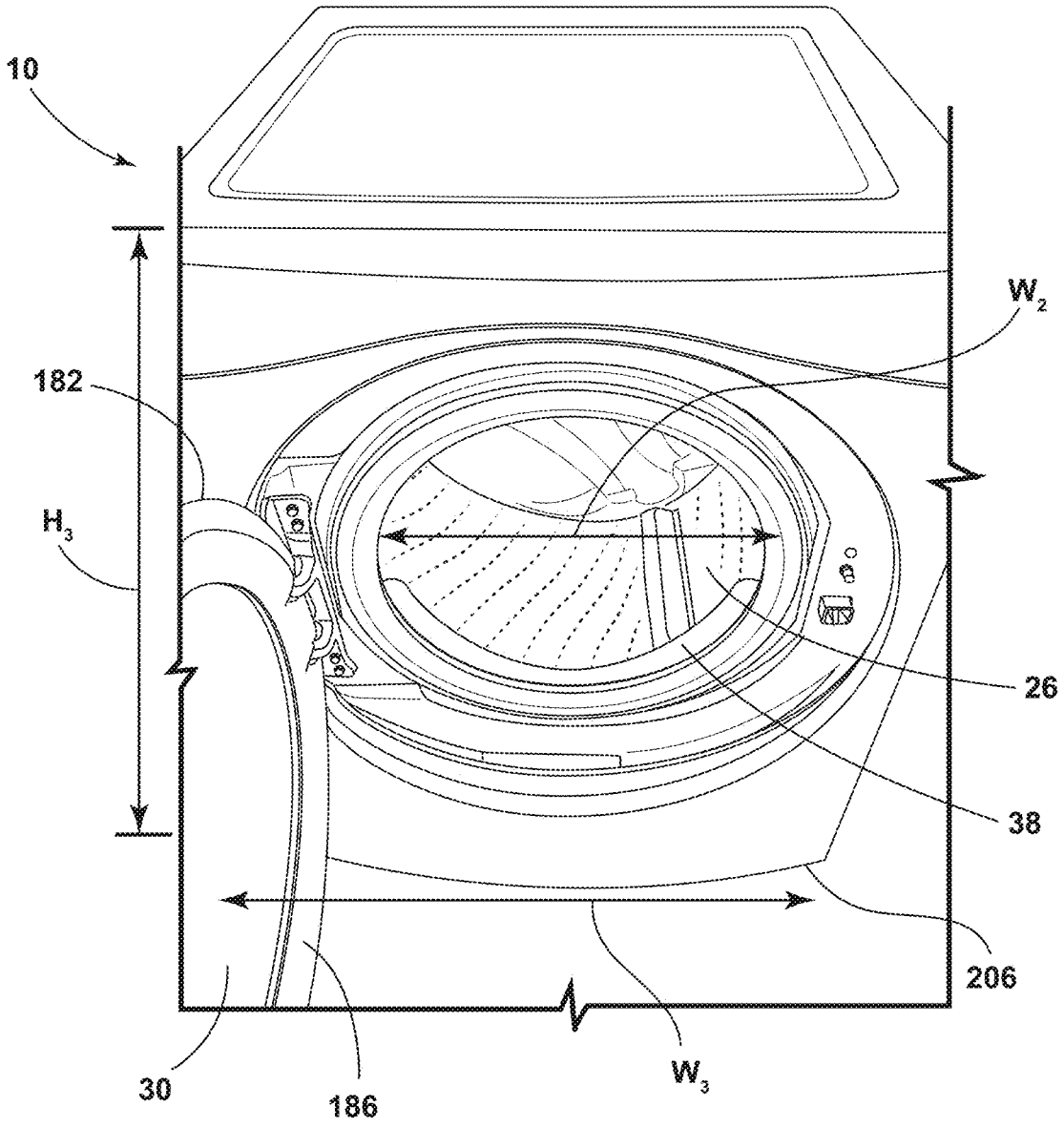
FIG. 19 is a partial front perspective of a laundry appliance that has a flat panel swing door, according to at least one example.

Referring to FIG. 19, the door 30 may be a substantially planar panel swing door. In such examples, an exterior surface 182 and an interior surface 186 of the door 30 are substantially flat. Having a flat panel door 30 is advantageous to improve the aesthetics of the washer 10 while using the deflector 38 to deflect laundry 66 (FIG. 2) rather than the glass bowl panel 170 (FIG. 18). The deflector 38 and the flat panel door 30 may also improve user access to the drum 26 and usability of the washer 10. Additionally, use of the deflector 38 is advantageous to allow use of the flat panel door 30 on washers 10 that have dimension constraints, which can prevent or hinder the use of the glass bowl panel 170 (FIG. 18).

Figure 20:
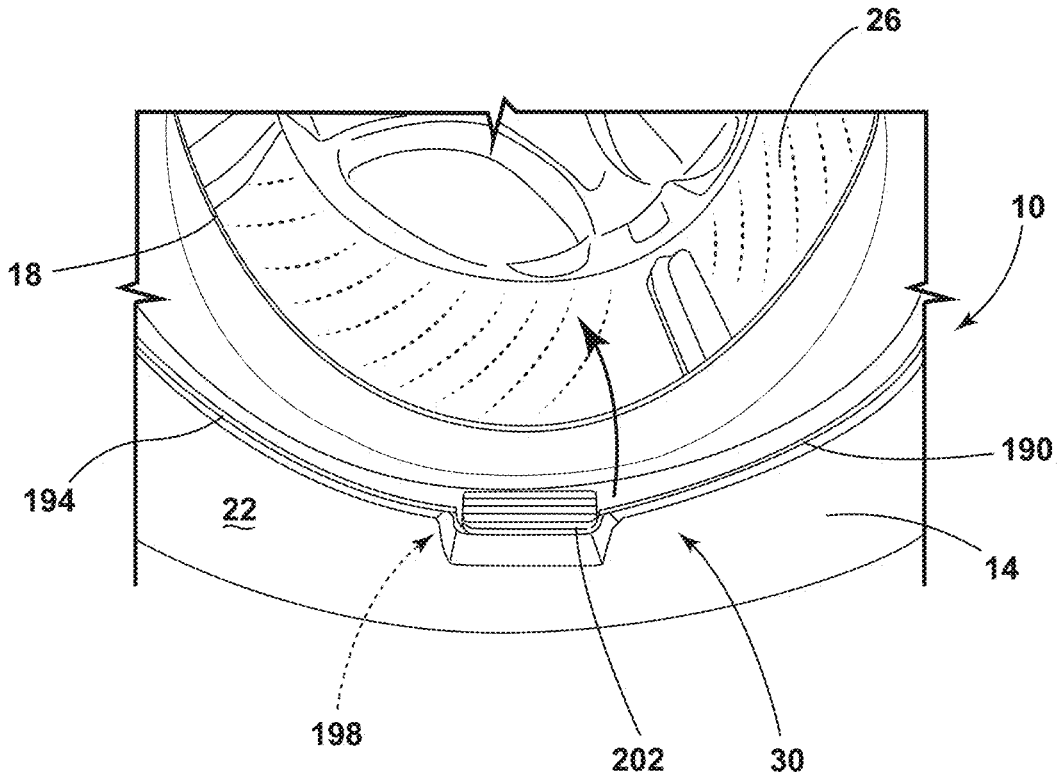
FIG. 20 is a partial front perspective view of a laundry appliance that has a glass panel sliding door, according to at least one example.

Referring to FIG. 20, the door 30 may be a sliding glass panel 190 configured to slide from a position covering the aperture 18 to a downward location within the cabinet 14 of the washer 10 to allow access to the drum 26. In such examples, the cabinet 14 of the washer 10 defines a slot 194 for accessing a chamber 198 proximate the front surface 22 of the cabinet 14. Stated differently, the cabinet 14 defines the chamber 198 for receiving and housing the sliding glass panel 190 in the opened position. The sliding glass panel 190 slidably engages the chamber 198. The sliding glass panel 190 typically includes a handle 202 to allow the consumer to move the sliding glass panel 190 over the aperture 18 and/or into the chamber 198. In the depicted example, the sliding glass panel 190 is illustrated in the chamber 198 positioned below the aperture 18, such that a consumer can pull the sliding glass panel 190 upwards to position the sliding glass panel 190 over the aperture 18. However, it is contemplated that the chamber 198 can be positioned in another location proximate the aperture 18 and, accordingly, the sliding glass panel 190 can be configured to move sideways and/or downwards to be positioned over the aperture 18. In various examples, the sliding glass panel 190 may be a single pane glass panel. Alternatively, the sliding glass panel 190 may be a double pane glass panel, which may be advantageous for high heat laundry applications.

Additionally or alternatively, the sliding glass panel 190 may also be motorized. In such examples, a user can activate a motor to operate the sliding glass panel 190. A control for the motor and/or motorized sliding glass door 190 may be incorporated into a user-interface of the washer 10 or may be a separate controller. Additionally, use of the deflector 38 in the washer 10 allows for the use of the sliding glass panel 190 as the door 30.

Referring now to FIGS. 19 and 20, in various non-limiting examples, the cabinet 14 of the washer 10 may have a width $w_3$ in a range of from approximately 40 cm to approximately 100 cm. The cabinet 14 can also have a height $h_3$ in a range of from approximately 60 cm to approximately 130 cm. The aperture 18 may have a width $w_2$ in a range of from approximately 20 cm to approximately 60 cm. In a non-limiting example, the cabinet 14 may have dimensions including the width $w_3$ of approximately 68 cm and the height $h_3$ of approximately 96 cm, with the aperture 18 having the width or diameter $w_2$ of approximately 40 cm. In such examples, the slot 194 that provides the access point for the chamber 198 can be positioned in a range of from approximately 20 cm to approximately 60 cm above a bottom surface 206 of the washer 10 (i.e., spaced away from a floor). The sliding glass panel 190 is typically positioned directly below the aperture 18 in the cabinet 14 and is movable into and out of the chamber 198.

In another non-limiting example, the cabinet 14 of the washer 10 can have a width $w_3$ in a range of from approximately 30 cm to approximately 90 cm. The cabinet 14 may also have a height $h_3$ in a range of from approximately 50 cm to approximately 110 cm. For example, the cabinet 14 may have dimensions including the width $w_3$ of approximately 60 cm and the height $h_3$ of approximately 86 cm. In various examples, the slot 194 that provides the access point for the chamber 198 can be positioned in a range of from approximately 15 cm to approximately 50 cm above the bottom surface 206 of the washer 10 (i.e., spaced away from a floor). The sliding glass panel 190 is typically positioned directly below the aperture 18 in the cabinet 14 and is movable into and out of the chamber 198.

Figure 21:
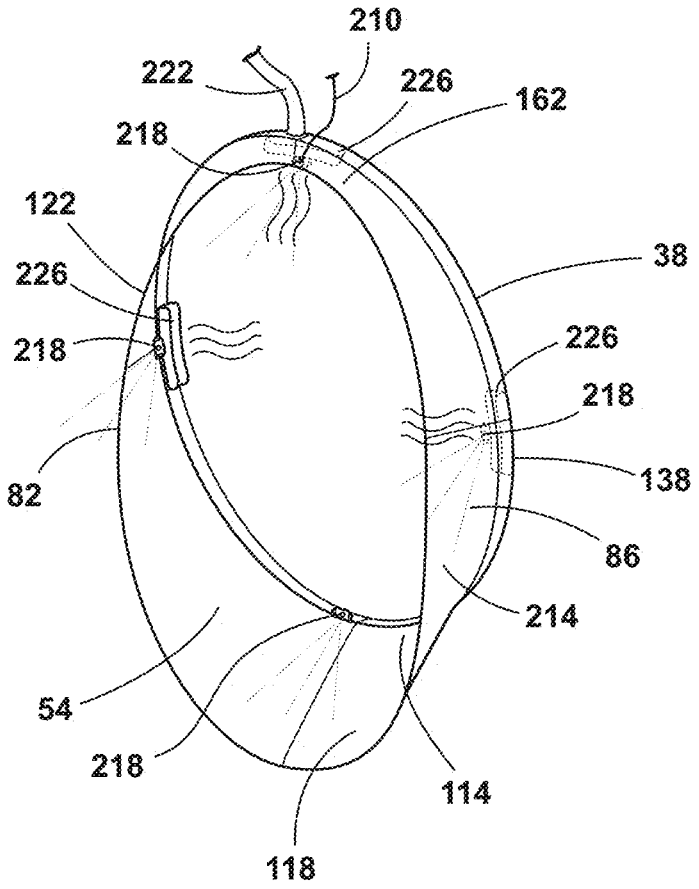
FIG. 21 is a rear perspective view of a deflector associated with a water system and a heat system, according to at least one example.

Referring to FIGS. 1, 2, and 21, the deflector 38 can be associated with at least one of a fluid delivery system and/or a heat system of the laundry appliance 10. In examples where the deflector 38 is associated with the fluid delivery system, piping 210 extends from the fluid delivery system to the deflector 38. The piping 210 typically extends at least partially along an outer surface 214 of the deflector 38. The piping 210 may be integrally formed with the deflector 38, or alternatively, may be coupled to the deflector 38 by coupling members, such as clips, snap features, or other fasteners. The piping 210 extends partially, or entirely, around a perimeter of the deflector 38. The piping 210 is coupled to one or more spray nozzles 218 coupled to the deflector 38. As illustrated in FIG. 21, four spray nozzles 218 are coupled to the deflector 38. One deflector 38 is in fluid communication with the top 162, one spray nozzle 218 is coupled to each of the side portions 82, 86, and one spray nozzle 218 is coupled to the bottom 114 of the deflector 38. However, it is contemplated that the deflector 38 may couple with any practicable number of spray nozzles 218 in any practicable location and/or arrangement on the deflector 38. According to various aspects, fluid travels from the fluid system, through the piping 210, and through the spray nozzles 218 toward the drum 26 and/or along the deflector 38. The fluid can be supplied to the drum 26 and/or be used to clean the deflector 38. The spray nozzles 218 may be used in addition to or as an alternative for spray nozzles 218 associated with the bellows 34 or other features of the laundry appliance 10.

The deflector 38 may additionally or alternatively be associated with the heating system of the laundry appliance 10. In such examples, ductwork 222 extends from the heat system to the deflector 38. The ductwork 222 typically extends at least partially along the outer surface 214 of the deflector 38. The ductwork 222 may be integrally formed with the deflector 38, or alternatively, may be coupled to the deflector 38 by coupling members, such as clips, snap features, or other fasteners. The ductwork 222 extends partially, or entirely, around the perimeter of the deflector 38. The ductwork 222 is in fluid communication with one or more inlets 226. As illustrated in FIG. 21, the deflector defines three inlets 226. One inlet 226 is defined in the top 162 of the deflector 38 and one inlet 226 is defined in each of the side portions 82, 86. However, the deflector 38 may include any practicable number of inlets 226 in any practicable location and/or arrangement on the deflector 38. Air flows from the heat system, through the ductwork 222, and through the inlets 226 toward the drum 26. The airflow from proximate the deflector 38 is advantageous in combined washer/dryer configurations to provide additional access points for the air into the drum 26, which can increase the efficiency of the drying process. The ductwork 222 and inlets 226 can be used in addition to, or as an alternative to, any heating elements associated with the bellows 34 or other features of the laundry appliance 10. The deflector 38 is a substantially stationary feature of the laundry appliance 10, and coupling the piping 210 and/or ductwork 222 to the stationary deflector 38 is advantageous for decreasing vibrations of the various components. It is contemplated that the laundry appliance 10 can include the deflector 38 associated with one or both of the water system and the heat system.

Use of the present disclosure provides a variety of advantages. For example, conventional horizontal-axis washing machines often require a fishbowl-style glass door to prevent clothing from remaining in a bellows area. The washer 10 can limit the use of the fishbowl-style door by including the deflector 38. The washer 10 of the present disclosure can provide for the horizontal-axis washer 10 with the deflector 38 to direct laundry 66 into the drum 26 and/or away from the bellows 34. Further, use of the deflector 38 can also allow use of the flat panel swing door 30. Also, use of the deflector 38 can allow for the washer 10 to include the sliding glass panel 190 as the door 30. Additional benefits of using this device may be realized and/or achieved.

According to at least one aspect, a laundry appliance includes a cabinet defining an aperture in a front surface thereof. A drum is disposed within the cabinet. The drum defines an access opening that aligns with the aperture. A door is coupled to the cabinet and is operable between closed and opened positions relative to the aperture. A bellows extends along a perimeter of the aperture and proximate the access opening. A deflector extends along at least a portion of the perimeter of the aperture. The deflector extends into an interior of the drum over the bellows.

According to another aspect, a deflector extends along an entire perimeter of an aperture.

According to another aspect, a top of the deflector extends a first depth toward an interior of a drum and a bottom extends a second depth. The second depth is greater than the first depth.

According to another aspect, side portions of the deflector extend a third depth toward an interior of the drum. The third depth is greater than a first depth and less than a second depth.

According to another aspect, exterior and interior surfaces of a door are substantially planar.

According to another aspect, an aperture is defined on a first plane, an access opening is defined on a second plane, and an interior edge of a deflector extends along a third plane. Each of the first, second, and third planes are different.

According to another aspect, a spray nozzle is coupled to a deflector for providing fluid to a drum.

According to at least one aspect, a laundry appliance includes a cabinet that defines an aperture. A drum is disposed within the cabinet. The drum defines an access opening that aligns with the aperture. A bellows is coupled to the cabinet proximate the aperture. A deflector is coupled to the cabinet proximate the aperture and extends toward the drum over the bellows. The deflector includes a top coupled proximate an upper portion of the aperture and a bottom coupled to a bottom portion of the aperture. The bottom has a greater depth than the top.

According to another aspect, a deflector includes side portions that extend between a top and a bottom. The side portions include respective sloping side edges.

According to another aspect, side portions have an increasing depth from proximate a top of a deflector to proximate a bottom defined by sloping side edges.

According to another aspect, an aperture defines a perimeter. A deflector extends along the entire perimeter of the aperture.

According to another aspect, a door is coupled to a cabinet. Exterior and interior surfaces of the door are substantially planar.

According to another aspect, a cabinet defines a chamber proximate an aperture.

According to another aspect, a door is slidably engaged with a cabinet and configured to slide into a chamber in an opened position and over an aperture in a closed position.

According to another aspect, a lower extension of a deflector extends at an oblique-orientation toward a lower portion of the drum.

According to at least one aspect, a laundry appliance includes a cabinet that defines an aperture. A tub is positioned within the cabinet. A drum is positioned within the tub. The tub defines an interior. A bellows is coupled to the cabinet and extends between the cabinet and the tub. A deflector is coupled to the cabinet proximate the aperture. The deflector includes a bottom and side portions extending therefrom. The bottom is coupled to the cabinet proximate a lower portion of the aperture and the side portions are coupled to the cabinet proximate respective sides of the aperture.

According to another aspect, each side portion includes an inward extension that extends towards an interior of a drum and a sloped portion that slopes at an oblique-orientation between the inward extension and a lower extension.

According to another aspect, a door is coupled to the cabinet. The door is a sliding glass panel.

According to another aspect, a cabinet defines a chamber for receiving a door when in an opened position.

According to another aspect, a deflector extends less than 180° around a perimeter of an aperture.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance, comprising:

a cabinet defining an aperture in a front surface thereof;

a drum disposed within the cabinet, wherein the drum defines an access opening that aligns with the aperture;

a door coupled to the cabinet and operable between closed and opened positions relative to the aperture;

a bellows extending along a perimeter of the aperture and proximate the access opening; and a deflector extending along at least a portion of the perimeter of the aperture, wherein the deflector includes a rim coupled to the cabinet proximate to the aperture and an arcuate body that extends from the cabinet into an interior of the drum over the bellows, and wherein the deflector is a stationary feature coupled to the cabinet.

2. The laundry appliance of claim 1, wherein the deflector extends along the entire perimeter of the aperture.

3. The laundry appliance of claim 2, wherein a top of the deflector extends a first depth toward the interior of the drum and a bottom extends a second depth, and wherein the second depth is greater than the first depth.

4. The laundry appliance of claim 3, wherein side portions of the deflector extend a third depth toward the interior of the drum, and the third depth is greater than the first depth and less than the second depth.

5. The laundry appliance of claim 1, wherein exterior and interior surfaces of the door are substantially planar.

6. The laundry appliance of claim 1, wherein the aperture is defined on a first plane, the access opening is defined on a second plane, and an interior edge of the deflector extends along a third plane, wherein each of the first, second, and third planes are different, wherein the second plane is at a first angle relative to the first plane and the third plane is at a second angle relative to the first plane, wherein the first angle is different than the second angle.

7. The laundry appliance of claim 1, further comprising:
a spray nozzle integrally formed with the deflector for providing fluid to the drum.

8. A laundry appliance, comprising:
a cabinet defining an aperture;
a drum disposed within the cabinet, wherein the drum defines an access opening that aligns with the aperture;
a bellows coupled to the cabinet proximate the aperture; and
a deflector having a rim coupled to a front panel of the cabinet proximate the aperture and an arcuate body extending from the front panel, toward the drum, and over the bellows, wherein the deflector includes a top coupled proximate an upper portion of the aperture and a bottom coupled to a bottom portion of the aperture, and wherein the bottom has a greater depth than the top.

9. The laundry appliance of claim 8, wherein the deflector includes side portions extending between the top and the bottom, and wherein the side portions include respective sloping side edges.

10. The laundry appliance of claim 9, wherein the side portions have an increasing depth from proximate the top of the deflector to proximate the bottom defined by the sloping side edges.

11. The laundry appliance of claim 8, wherein the aperture defines a perimeter, and wherein the deflector extends along the entire perimeter of the aperture.

12. The laundry appliance of claim 8, further comprising:
a door coupled to the cabinet, wherein exterior and interior surfaces of the door are substantially planar.

13. The laundry appliance of claim 12, wherein the cabinet defines a chamber proximate the aperture.

14. The laundry appliance of claim 13, wherein the door is slidably engaged with the cabinet and configured to slide into the chamber in an opened position and over the aperture in a closed position.

15. The laundry appliance of claim 8, wherein a lower extension of the deflector extends at an oblique-orientation toward a lower portion of the drum.

16. A laundry appliance, comprising:
a cabinet defining an aperture;
a tub positioned within the cabinet;
a drum positioned within the tub, wherein the tub defines an interior;
a bellows coupled to the cabinet and extending between the cabinet and the tub; and
a deflector directly attached to the cabinet proximate the aperture and configured to extend over the bellows, wherein the deflector includes a bottom and side portions extending therefrom, and wherein the bottom is coupled to the cabinet proximate a lower portion of the aperture and the side portions are coupled to the cabinet proximate respective sides of the aperture.

17. The laundry appliance of claim 16, wherein each of the side portions includes an inward extension extending towards the interior of the drum and a sloped portion that slopes at an oblique-orientation between the inward extension and a lower extension.

18. The laundry appliance of claim 16, further comprising:
a door coupled to the cabinet, wherein the door is a sliding glass panel.

19. The laundry appliance of claim 18, wherein the cabinet defines a chamber for receiving the door when in an opened position.

20. The laundry appliance of claim 18, wherein the deflector extends less than 180° around a perimeter of the aperture.

* * * * *